US005447389A

United States Patent [19]

Olson

[11] Patent Number: 5,447,389

[45] Date of Patent: Sep. 5, 1995

[54] INSULATION SYSTEM FOR SOIL

[75] Inventor: Michael A. Olson, Ann Arbor, Mich.

[73] Assignee: Abeltech Incorporated, Ann Arbor, Mich.

[21] Appl. No.: 123,633

[22] Filed: Sep. 17, 1993

Related U.S. Application Data

[63] Continuation-in-part of Ser. No. 985,124, Jan. 15, 1993, abandoned.

[51] Int. Cl.[6] ..... E02D 31/00; B09B 5/00

[52] U.S. Cl. ..... 405/129; 405/270

[58] Field of Search ..... 405/16, 17, 19, 52, 405/53, 55, 56, 128, 129, 217, 45, 258, 270; 52/169.11

[56] References Cited

U.S. PATENT DOCUMENTS

| | | | |
|---|---|---|---|
| 752,637 | 2/1904 | Mankedick | 405/16 |
| 3,707,850 | 2/1973 | Connell et al. . | |
| 3,750,412 | 8/1973 | Fitch et al. | 405/217 |
| 3,846,989 | 11/1974 | Burt et al. . | |
| 4,565,468 | 1/1986 | Crawford | 405/270 |
| 4,815,963 | 3/1989 | Berkhout | 405/129 X |
| 4,984,594 | 1/1991 | Vinegar et al. | 405/129 X |
| 5,056,960 | 10/1991 | Marienfeld . | |

FOREIGN PATENT DOCUMENTS

| | | | |
|---|---|---|---|
| 560165 | 9/1957 | Belgium | 405/19 |
| 2558192 | 7/1985 | France | 52/169.11 |
| 1479772 | 7/1977 | United Kingdom | 405/45 |
| 92/10617 | 6/1992 | WIPO | 405/19 |

OTHER PUBLICATIONS

Dervent 86-156540/25 (Abs DE 444728).
Dervent 87-178862/26 (Abs DE 546032).

*Primary Examiner*—David H. Corbin
*Attorney, Agent, or Firm*—Robert L. McKellar

[57] ABSTRACT

This invention deals with casings useful for fabricating articles used in insulation methods and a blanket type thermal insulation formed from such articles that can be placed on substrates to prevent exaggerated changes in temperature of the substrate. The flexibility of the blanket allows for its use on a variety of configurations of substrates.

29 Claims, 5 Drawing Sheets

INSULATION SYSTEM FOR SOIL

This is a continuation-in-part of application Ser. No. 07/985,124, filed on Jan. 15, 1993, now abandoned.

FIELD OF THE INVENTION

With specificity, this invention deals with a blanket type thermal insulation that can be placed on substrates to prevent exaggerated changes in temperature of the substrate. The flexibility of the blanket allows for its use on a variety of configurations of substrates.

BACKGROUND OF THE INVENTION

There are many uses for thermal insulation that do not require any physical attributes from the insulating material except the ease of use and the thermal properties of the insulating material itself. For example, houses and other buildings can be insulated with sheets of rigid plastic foam which can be tacked to the exterior frame of the house before the siding is placed on the house. In another example, the interior of houses can be insulated because their very construction allows for the placement of insulating batting or beaded or particulate materials in existing chambers such as on top of ceilings, between ceiling joists, in walls between wall studs, and the like.

However, there are also a multitude of uses in which the insulating material cannot be used unless it is modified or configured to fit the particular end use. Examples of such uses can be found for example in U.S. Pat. No. 3,707,850 to Connell, et al, which issued on Jan. 2, 1973, in which insulating material is bagged up in small bags, and a multitude of these bags are layered to insulate a chamber placed in the earth.

Another special configuration to provide insulation to a substrate can be found in an abstract from Derwent Publications Ltd. 86-156540/25, abstracting German patent 444,728, in which polystyrene foam sheets are prepared having at least one corrugated surface in order to fit the corrugated surface of a roof. The polystyrene sheet in then top coated with concrete to hold it in place.

A further publication of special insulation can be found in 1987 Derwent Publications 87-178862/26 abstracting German patent DE 546,032, in which prefabricated rectangular panels, each having a core made of hard plastic foam materials, preferably polystyrene, are used to cover a roof made of corrugated asbestos cement sheets.

Yet another approach to insulating an embankment foundation for liquid storage, especially in cold climates such as Alaska, is shown in U.S. Pat. No. 3,846,989, issued to Burt, et al, on Nov. 12, 1974. The so-called "Arco" insulation is a foamed-in-place polyurethane insulation layer that is sprayed directly on the substrate and allowed to foam and cure. No coverings or carriers for this foam are disclosed or shown.

The Burt et al patent describes in intimate detail, the problems associated with attempts to insulate portions of the earth's substrate. The invention disclosed herein, in it's various embodiments, overcomes many of the problems described by Burt et al.

In order to service those activities associated with the insulation of the earth's surface, the materials used must have sufficiently low thermal conductivity and/or sufficient thickness to protect the soil from freezing or reaching hot temperatures. The materials must have sufficient strength and durability to withstand the rigors of installation and use and must be resistant to weathering, including precipitation, wind, ultraviolet radiation, and temperature extremes. The material must be cost effective and must be simple to produce, install, remove if it is no longer needed, and re-use if it is needed elsewhere. Installation and removal should pose a minimum of disruption to existing operations and construction practices. The material should be capable of being installed and removed without damage to the underlying substrate and finally, the installation and use of the material should minimize risks to the health and safety of personnel using the material.

THE INVENTION

The casings, articles, methods and systems of this invention overcome a large majority of the problems associated with thermally insulating a large variety of substrates which in some cases may have a complex surface configuration.

Significant advantages are provided by this invention, among them: ease of evenly distributing and securing a loose-fill, or foamed insulating material on a substrate so that it cannot be redistributed by wind, precipitation, erosion, or other forces; ease of protecting the insulative material from precipitation, water infiltration, and icing that may render it ineffective; ease of removal and re-use of the insulative material; ease of installation and removal of the insulative material without damaging the substrate, and cost effectiveness, among many other advantages.

One of the biggest potential uses for the articles of this invention is in thermal insulation of compacted clay hydraulic barriers which are subjected to high and low temperatures, which temperatures, affect the usefulness of the compacted clay for its purpose.

Compacted clay is widely used in the construction of hydraulic barriers to attenuate fluid flow and to prevent the migration of contaminants into the environment. Some examples are landfill liners and covers; remediation site covers; secondary containment structures; and liners for surface impoundments, storage ponds, sewage lagoons, and heap-leaching pads. These hydraulic barriers are often left partially exposed to atmospheric and solar-induced temperature extremes that have recently been found to impair the ability of compacted clay to attenuate flow.

Several recent laboratory studies by Chamberlain et al. 1990, Zimmie and Laplante 1990, Benson and Othman 1992, have shown that successive freezing and thawing of compacted clay increases its hydraulic conductivity by one to three orders of magnitude. Also, Corser et al suspect that high temperatures and temperature fluctuations are the cause of severe desiccation cracking which has recently been observed in the compacted clay components of geomembrane-clay composite landfill liners and covers. This cracking results in the creation of conduits for fluid flow, thereby increasing the hydraulic conductivity of the compacted clay.

Because the objective of hydraulic barriers is to attenuate fluid flow, the hydraulic conductivity of compacted clay used in their construction is of primary importance to performance. A general conclusion from the aforementioned research is that compacted clay should be protected from temperature extremes if low hydraulic conductivity is to be maintained. Some state environmental regulatory agencies have recognized this. Minnesota, Wisconsin, and Ohio, for example require freeze-thaw protection of landfill liners that are not covered with waste during winter.

Protection of the hydraulic barrier may be accomplished by covering it with a sufficiently thick layer of the impounded material soon after construction and before the onset of the offending climatic conditions. Such a material may be solid waste in the case of a landfill liner. However, there are many cases where it is inconvenient or impossible to completely cover a hydraulic barrier with sufficient impounded material in time to prevent exposure to temperature extremes.

For example, a landfill cell that is first placed into service in the fall may not receive the volume of solid waste necessary to completely cover the liner prior to winter, and areas of the liner will remain exposed to freezing and thawing. This is frequently the case for cells with steep slideslopes that are difficult to cover with the minimum thickness of waste without concurrently filling the interior of the cell. There may also be areas of the liner that, by necessity, must remain uncovered by waste for extended periods, such as storm water and leachate detention areas, and areas awaiting tie-in to the liner of an adjacent cell.

Protection of the liner from temperature extremes should be considered in the layout of new landfill cells, but it must be reconciled with many other considerations. Building smaller cells to allow for earlier coverage of the liner with waste may interfere with important aspects of the overall landfill development plan. Building flatter sideslopes, also providing for earlier coverage, has the serious economic disadvantage of reducing landfill volume capacity. Similarly, building thicker liners in order to compensate for damage caused by temperature extremes also reduces volume capacity.

Insofar as there are many such cases where it is inconvenient or impossible to completely cover hydraulic barriers with sufficient impounded material in time to prevent exposure to temperature extremes, there is reason for investigation of alternative materials for supplemental protection. This has been done for the case of protecting a compacted clay landfill liner in southeast Michigan against freeze-thaw, as presented in the following paragraphs. It is thought that the outcome of this exercise can be applied to other cases of hydraulic barriers and to protection of hydraulic barriers from excessive heating.

Table 1 shows typical thermal conductivities, k (W/(MK), wherein MK is meter. Kelvin, at 300K and atmospheric pressure, of various natural substances and common insulating materials, and their corresponding minimum thicknesses that are theoretically necessary to protect a compacted clay landfill liner in southeast Michigan from freezing during a 30 year design winter. The design winter and thicknesses were determined based on an understanding of the ground thermal regime presented by Andersland and Anderson and the analytical methods contained therein.

Because of its gaseous state and very low density, air offers the highest resistance to conductive heat transfer. However, because it is fluid and prone to circulation when exposed to temperature gradients, air readily transfers heat by convection and is by itself a poor thermal insulator. Insulations function by partitioning air into tiny void spaces within a solid matrix, thereby preventing convection and allowing for use of the low thermal conductivity of air. The thermal properties of an insulation are then a function of the thermal properties of the air and of the solid material that partitions the air. Table 1 shows that the most effective insulation, such as polystyrene and polyurethane, have thermal conductivities that approach that of air alone. As a practical matter, one inch appears to be the limiting minimum thickness necessary for any insulation devised to protect the landfill liner.

Water is shown in Table 1 to illustrate the negative effect it can have on the performance of thermal insulations. It has a relatively high thermal conductivity and will significantly increase the thermal conductivity of an insulation if it is allowed to infiltrate into the void spaces of the material that are normally occupied by air. It follows that insulating materials must be protected from, or resistant to, precipitation and water infiltration to maintain effectiveness in protecting the liner. In the case of foamed insulations such as polystyrene or polyurethane, a closed-cell matrix is more resistant to water infiltration than an open-cell matrix.

Although the thermal conductivity of ice is very high, a specific form of ice, fresh snow, can be an effective insulator because of its low density and the air partitioned within the ice matrix. Although natural snow cannot be relied upon and is of little practical value for insulation , the possibility of using artificial snow-making technology to protect the landfill liner is acknowledged, but is not within the scope of this specification.

The 48 inch minimum thickness shown for clay in Table 1 roughly corroborates the 42 inch minimum foundation depth typically specified in local building codes, the discrepancy being attributed to different design winter and soil property assumptions.

TABLE I

THERMAL CONDUCTIVITY AND THICKNESS

| | Thermal Conductivity W/(m K) | Thickness in. |
|---|---|---|
| Natural Substances | | |
| Air | 0.024 | 1 |
| Water | 0.602 | 24.2 |
| Snow, fresh | 0.105 | 4.23 |
| Snow, drifted and compacted | 0.335 | 13.5 |
| Ice | 2.22 | 89.3 |
| Clay, 115#/cf, 12% water content | 1.2 | 48 |
| Dry Gravel | 2.3 | 91 |
| Insulation Materials | | |
| Loose Fills | | |
| Cellulose, wood or paper | 0.039 | 1.6 |
| Perlite | 0.053 | 2.1 |
| Vermiculite | 0.069 | 2.8 |
| Diatomaceous silica | 0.061 | 2.4 |
| Polystyrene, expanded | 0.042 | 1.7 |
| Batt or Blanket | | |
| Fiberglass, paper faced | 0.044 | 1.8 |
| Rock wool | 0.044 | 1.8 |
| Rigid Board | | |
| Cellular glass | 0.058 | 2.3 |
| Polystyrene, extruded | 0.029 | 1.2 |
| Polystyrene, expanded, molded | 0.042 | 1.7 |
| Wood, Shredded/cemented | 0.087 | 3.5 |
| Mineral fiberboard | 0.049 | 2.0 |
| Foamed or cast in Place | | |
| Polyurethane, rigid foam | 0.026 | 1.0 |
| Insulating Concrete | 0.131 | 5.28 |

Because of high density and water content, soils are generally poor thermal insulators and must be applied in substantial thickness to achieve the necessary protection. Soils are thus dismissed from practical consideration for protection of the landfill liner because of the expense and difficulty of placing such a large volume of material over the liner. The soil itself may be expensive, the earthwork involved in placing or removing the soil is expensive and difficult when placed over geosynthetics, and if left in place, the soil consumes significant landfill volume capacity.

Table 1 also shows categories of common insulating materials that, in practical minimum thicknesses of only a few inches, can theoretically protect the landfill liner from freezing. However, each of these insulations alone have characteristics that impair their utility and effectiveness in this application. Of primary significance is the fact that they are generally not intended to be exposed to the elements during use. Susceptibility to weathering; insufficient durability; difficulty of installation, removal and re-use; problematic side effects; and expense have generally hindered the use of these materials in the protection of landfill liners from freezing.

Loose fill, such as cellulose, perlite, vermiculite, diatomaceous silica, and expanded polystyrene are susceptible to water infiltration from precipitation, subsequent icing, and erosion from wind and precipitation. Also, the use of loose fills can pose operational problems. As a case in point, the use of straw in a landfill cell in Wisconsin resulted in premature generation of leachate.

This was a newly constructed six acre cell with a geomembrane/clay composite liner with 3 horizontal : 1 vertical sideslopes, and a one foot thick granular leachate collection layer over the liner. Construction of the cell was completed in the fall of 1988 and it did not need to be placed into service until the spring of 1989 because sufficient waste volume capacity remained in the proceeding cell.

Approximately eight inches of straw was broadcast over the entire liner including the sideslopes and floor to protect the liner from freezing during the upcoming winter. Snow accumulated over the straw during the first weeks of winter giving an indication that the straw was preventing heat escape from the underlying soils, and then partially melted during a January thaw, leaving behind a compacted wet mat of straw.

Decay of the straw apparently caused a precipitous increase in biological oxygen demand in the runoff to levels exceeding 1000 mg/l, that accumulated in the sump. This runoff, that normally would be released as uncontaminated storm water because the cell had not yet received waste, had to be removed and treated as leachate at an additional cost of approximately seven thousand dollars. Furthermore, it was apparent that the matted straw may impair drainage into the leachate collection layer, and it had to be removed. A low ground pressure bulldozer the straw mat into large piles that were left on the floor. Fortunately, freezing conditions allowed for this operation without damaging the granular leachate collection layer or the underlying geomembrane.

Fiberglass blankets or batting are also susceptible to water infiltration and icing, and are difficult to secure over the liner so they will not be disturbed by wind. Further, they are subject to compaction from snow accumulation. Rigid boards, such as extruded or expanded polystyrene, may be less susceptible to water infiltration, but they are generally fragile in the minimum thicknesses shown and may not endure the rigors of installation and use in a landfill cell. It is difficult to conceive of how the boards can be reliably attached together and secured over the liner, or how they will conform to an irregular substrate topology without breakage.

It should be noted that the strength and durability of polystyrene boards may be improved by coating them with a sufficient thickness of a suitable polymeric substance. For example, a 3/16inch thick coating of polyurea plastic that is spray applied onto both sides of a one inch thick polystyrene board produces a hard, rigid, and lightweight board that is water resistant and resistant to breakage from impact and flexure. It is contemplated that a reliable means for attaching boards together can then be provided, making use of the added strength of the polyurea coating.

Lastly, foam or cast-in-place insulations, such as rigid polyurethane foam and insulating concrete are relatively expensive and require more sophisticated equipment and methods in their application. For example, foamed-in-place polyurethane is several times more expensive than polystyrene and requires the on-site use of hazardous chemicals to generate the foam.

An insulation used for supplemental protection of the landfill liner will be needed only for the time that the liner is potentially exposed to freezing. Once the liner is covered with sufficient solid waste, the insulation is no longer needed. With the possible exception for rigid boards, a shortcoming of the insulating materials listed in Table 1 is the difficulty of removal and re-use of these materials. If left in place, the insulation may potentially interfere with the functioning of the underlying leachate collection layer. Also, leaving the insulation in place consumes landfill volume capacity and forfeits cost savings per unit area of liner insulated that could be realized from re-use of the insulation.

It becomes apparent that there is a need for an insulation specifically designed to prevent compacted clay landfill liners from freezing. The current invention seeks to overcome the inadequacies of the aforementioned common insulating materials while taking advantage of the many favorable characteristics of one of these insulating materials.

Molded forms of polystyrene are widely used for packaging and thermal insulation. These molded forms are manufactured in a two step process at over one hundred facilities across the United States. Tiny beads of polystyrene resin containing small amounts of pentane as a blowing agent are heated with steam and pre-expanded to several times their original volume, and then molded into the desired shape, such as billets, or blocks. Horvath has recognized the use of molded polystyrene block for thermal insulation and other functions in geotechnical and civil engineering, primarily in Europe, since the 1960's. Expanded polystyrene is a "geofoam" the name for the newly crated geosynthetic product category including any type of foam used in geotechnical applications.

Loose expanded polystyrene beads have great potential for insulating landfill liners because of the following properties; very low thermal conductivity; resilient and crush resistant; chemically stable and inert; non-biodegradable; light weight, typically 1 to 2 pounds per cubic foot, the ability to control properties such as particle size, modulus, and density; easily pumped or pneumatically conveyed; inexpensive and readily available; and recyclable. The current invention seeks to use these properties while providing a means for evenly distributing and securing the beads in the desired thicknesses over the liner, protecting the beads from the elements, removing the beads when they are no longer needed, and re-using the beads if they are needed elsewhere. The invention herein is a new form of geosynthetic in that it is not known in the art.

Geosynthetics is the name for synthetic materials used in geotechnical, environmental and civil engineering applications and includes such materials as geomembranes, geotextiles, geonets, and geogrids. These terms are named via the prefix "geo" which means earth, followed by a descriptor of the form the material assumes. Consistent with this terminology the inventor herein has named one embodiment of this invention "geoinsulation" because it assumes the form of an insulating material.

Geoinsulation according to this invention, is a two component material in that it consists of a casing and an insulating material that fills the casing. In this specification, when the casing is filled with the insulating material, it is denoted as a "panel". When several of the panels are attached to one another, it is denoted as a "system". For purposes of this invention "articles" includes, but is not limited to, panels, such description being used herein for simplicity in defining the metes and bounds of the invention and should not be taken as limiting the scope of the invention as it is set forth in the appended claims.

The attaching of the panels to one another to form the system, essentially results in a blanket of insulating material. Because of the flexibility of the casing, the blanket essentially conforms to the topical surface of the substrate that is being insulated and this means that the blanket is very effective in its use.

Thus, the present invention generally relates to insulating soil. More particularly, the present invention relates to casings, and filled casings that are designed to prevent freeze-thaw damage in compacted clay hydraulic barriers by insulating these hydraulic barriers. In addition, this invention protects hydraulic barriers from overheating due to the sun, thereby preventing desiccation and cracking of compacted clay hydraulic barriers. Compacted Clay hydraulic barriers are well known in the fields of geotechnical, environmental, and civil engineering. For this reason, the specifics concerning the construction of compacted clay hydraulic barriers are not more fully discussed herein.

Composite hydraulic barriers which use one or more layers of synthetic membranes or fabrics i.e. geosynthetic systems referred to supra, in conjunction with compacted clay, are used to further attenuate fluid flow through the hydraulic barrier. Such systems are set forth in U.S. Pat. No. 5,056,960, issued on Oct. 15, 1991 to Marienfeld and the details of the elements can be found in that patent. Geosynthetic systems are also well known in the fields of geotechnical and civil engineering and for this reason they are not more fully discussed herein.

While it is known that the successive freeze and thaw, and excessive heating of compacted clay hydraulic barriers, has a detrimental effect on the hydraulic barrier's ability to attenuate the flow of fluids through the hydraulic barrier, geosynthetic systems presently in use are neither intended for nor designed to effectively insulate the hydraulic barrier against freezing or overheating. For this reason, preventing freezing and overheating of the compacted clay hydraulic barrier represents a challenge to engineers in the fields of geotechnical and civil engineering.

The present invention meets the above challenge and has as its principal object the providing of an insulating article for compacted clay hydraulic barriers. By insulating the hydraulic barrier, the present invention seeks to completely mitigate the effects of successive freeze-thaw cycles, or excessive heating, by actually preventing the occurrence of the freeze aspect of the cycle or excessive heating due to the sun.

Still another object of the present invention is to provide an insulating article which is cost effective to produce and employ in a large capacity landfill cell and which can be manufactured at a manufacturing facility, or can be partially manufactured at the site. Such landfill cells vary widely in size, but may often have a footprint in excess of five acres.

Yet another object of this invention is to provide an insulating article which can be effectively used to insulate the sideslopes of a landfill liner.

Further, the present invention also has as one of its objectives, providing an insulating article which is easily transported to and employed at the landfill site.

Finally, it is an objective of the present invention to provide methods of installing an insulating article to form a system for insulating soil.

In achieving the above and other objects, the present invention provides a blanket-type system which insulates and prevents freezing and exaggerated heating of soils. More specifically, the invention disclosed herein comprises one or more embodiments which comprise a casing for use in containing thermal insulation, wherein the casing comprises a flexible housing having spaced apart opposing side walls, wherein the side walls are connected to each other by a plurality of flexible fasteners which cause the side walls to cooperatively define at least two chambers therebetween. The casing also has a means for fastening the casing to another adjacent similar casing and a means for detachedly securing the casing on a substrate, such as soil.

Another embodiment of this invention is an article for thermally insulating a substrate. The article comprises a flexible casing and the casing is comprised of a flexible housing having spaced apart opposing side walls. The side walls are connected to each other by a plurality of flexible fasteners which cause the side walls to cooperatively define at least two chambers therebetween. There is contained in each of the chambers, insulative material sufficient to thermally insulate the substrate. There is also a means for fastening the casing to another similar casing to form a blanket type structure and, a means for detachedly securing the article on the substrate.

Finally, this invention comprises as yet another embodiment, a method of thermally insulating a substrate, wherein the method comprises preparing the substrate; covering the substrate with one or more articles as described just above; fastening each of the articles to at least one other similar adjacent article, and finally, detachedly securing one or more of the articles on the substrate.

It should be noted that further embodiments of this invention include methods wherein the surface to be insulated is pre-prepared followed by later application of the method described above. Also, it is contemplated within the scope of this invention to apply the method to soil, or soil covered with geosynthetic systems, which have not been prepared at all, that is, the method may be applied to existing substrates with little or no pre-preparation at all.

It should be further noted that methods are disclosed and claimed herein wherein the casing is transported to the site for construction of the system, which method includes the laying out of the casing and filling said casing with insulative material. As a further embodiment of this invention, the method additionally includes laying down all of the casing before the steps of filling with insulation are carried out.

And finally, there is disclosed and claimed herein, methods of constructing the casings and articles in a manufacturing facility for later transportation to the use site.

DETAILED DESCRIPTION OF THE INVENTION

Figure 1:
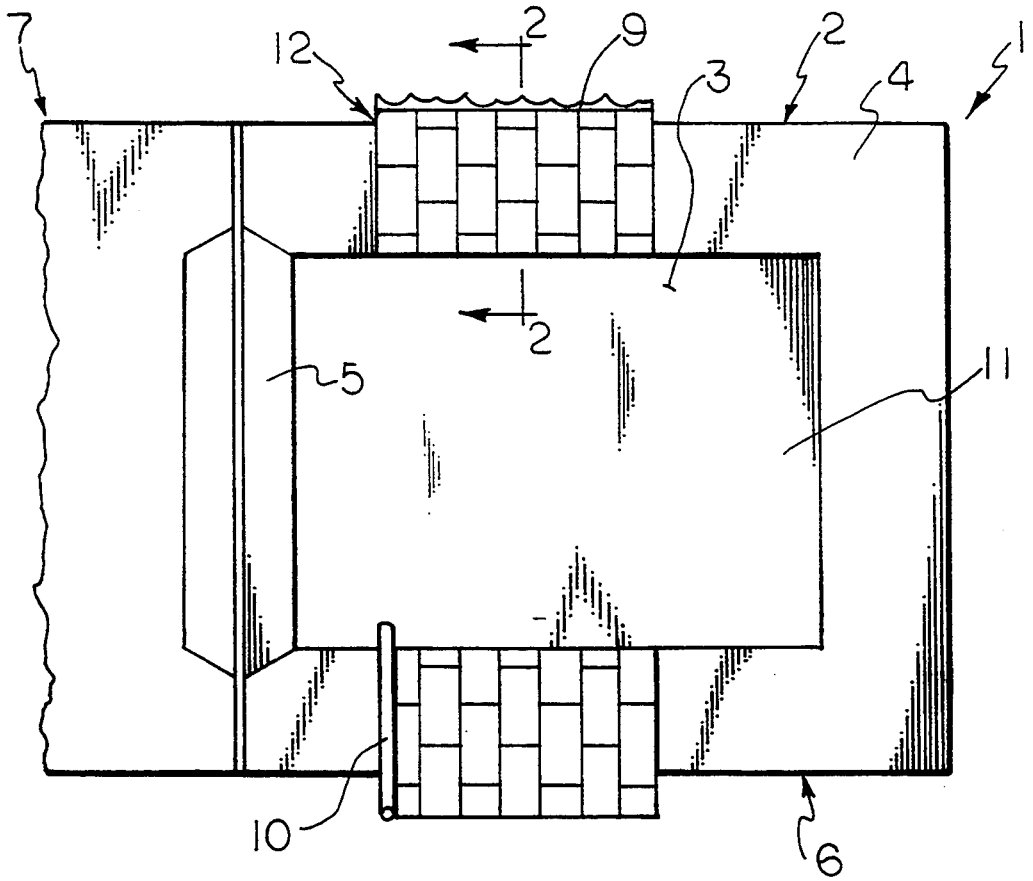
FIG. 1 is a diagrammatic top plan view of a partial landfill cell showing the present invention partially installed therein.
Figure 2:
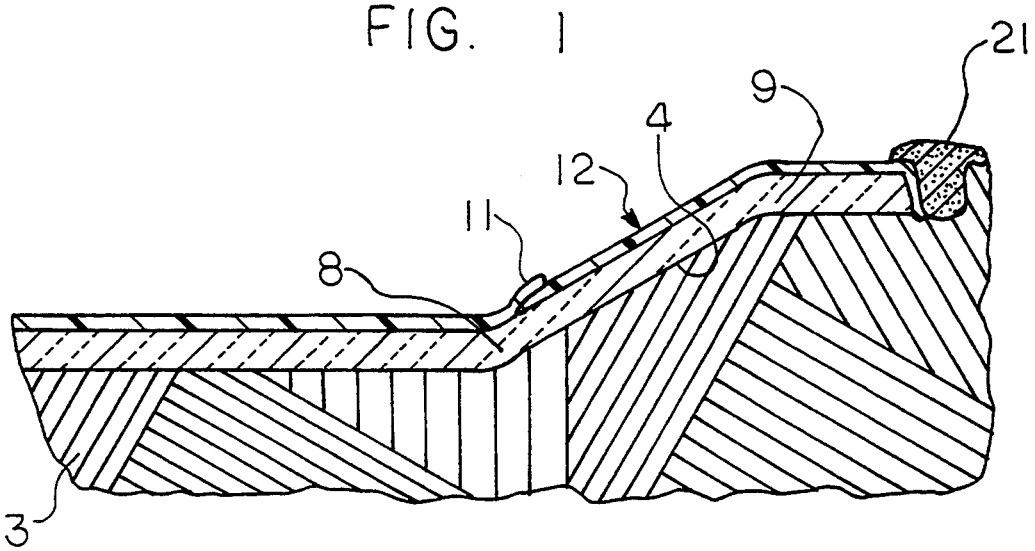
FIG. 2 is a side elevational cross-sectional view taken substantially along line 2—2 in FIG. 1 illustrating the landfill liner and the insulating system of the present invention.

Referring now to FIG. 1, there is shown a landfill containment cell designated at 1. The containment cell 1 is generally an excavated area of soil which has partially been replaced by a compacted clay liner 2 and, in certain sites, by a geosynthetic system as described supra. Hereinafter, it should be understood that any reference to the liner 2 is intended to include the possibility of a geosynthetic system with a clay liner. Since the specifics of compacted clay liners 2 and geosynthetic systems are well known in the field of geotechnical and civil engineering, these specifics are not further discussed herein. The liner 2 generally defines the containment cell 1 and includes a floor 3 and sideslopes 4, one of which may form an interior dike 5 separating an active cell 7 (not shown in detail) from a partially constructed cell 6.

Typically, the sideslopes 4 of a containment cell 1 proceed from the toe 8 of the sideslope 4 to its top 9 in a general slope and are not generally vertical walls. The particulars of the clay liner 2 itself, including the slope of the sideslopes, soil liner thickness, moisture content, density, hydraulic conductivity, soil classification, and thickness, will be dictated by local and federal regulations, along with the design considerations of the specific application.

The containment cell 1 will also often include an access pipe 10 that provides access for a sump to a leachate collection area, not shown in the Figure. The floor 3 of the clay liner exhibits, typically, a one to five percent grade and is covered with sand, or other granular soil, which will allow the leachate to naturally drain into the leachate collection area for subsequent removal by a sump pump. Additional measures, which are beyond the actual scope of the present invention and therefore are not discussed herein, might also be employed to enhance drainage.

Figure 4:
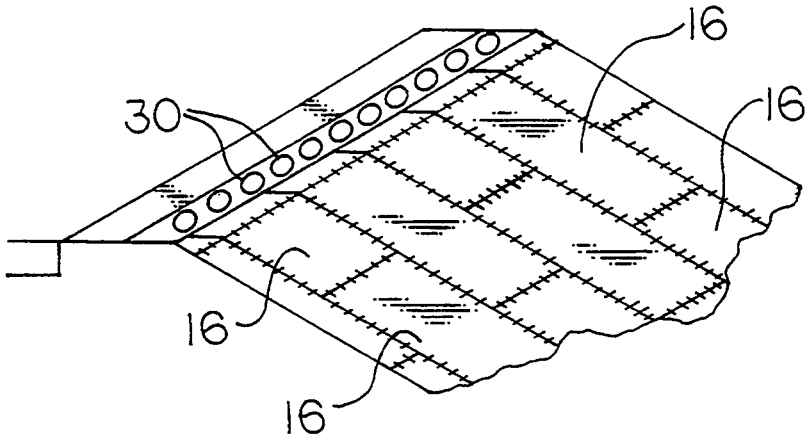
FIG. 4 is an isometric view of a portion of FIG. 3 showing the anchoring systems described in FIG. 3.
Figure 5:
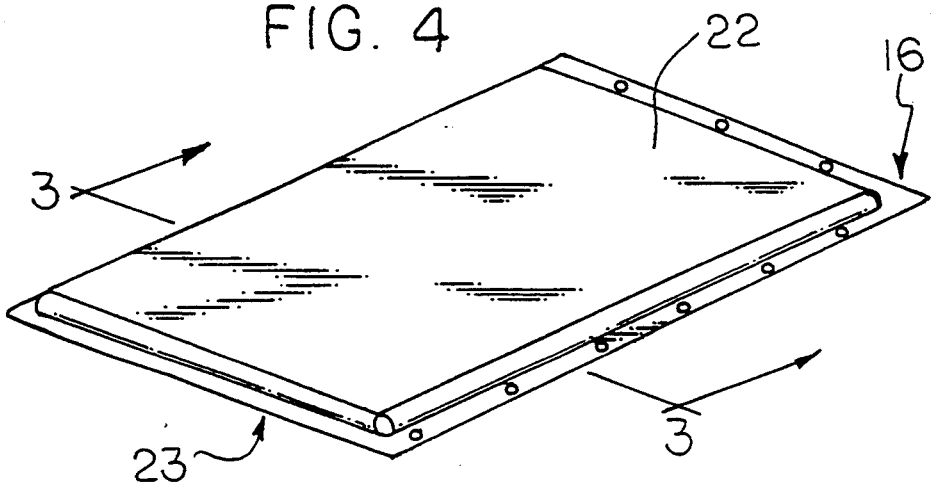
FIG. 5 is an isometric view of an expanded article of this invention, wherein it contains an insulating material.
Figure 6:
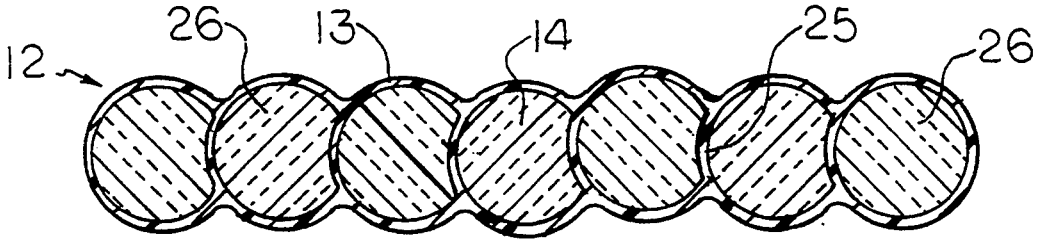
FIG. 6 is a cross-sectional view of an article of this invention in the filled or expanded state.

With reference to FIGS. 4 and 5, an insulating article of the present invention, hereinafter referred to as geoinsulation and designated generally at 12, is a two component article having two principal components, a casing 13, and insulation 14 as shown in FIG. 6. As an overview, the geoinsulation 12 is installed over the clay liner 2, in a blanket fashion, to take advantage of the geothermal properties of earth located beneath the liner 2 and thereby prevent the liner 2 from freezing or overheating. The discussion which follows details the components of the present invention and the associated activities of casing manufacture, article manufacture, article installation, and other related embodiments of the invention.

The casing 13, which will be dealt with in greater detail, infra, is the receptacle which contains the insulation 14 to provide the articles of this invention. The casing 13 also provides the means for placing the insulation 14 over the sideslope 4 and maintaining it in its proper position on the sideslopes 4. Furthermore, the casing 13 protects the insulation 14 from precipitation, wind, ultraviolet light from the sun, and other forms of weather which may render it ineffective or inoperable.

Figure 3:
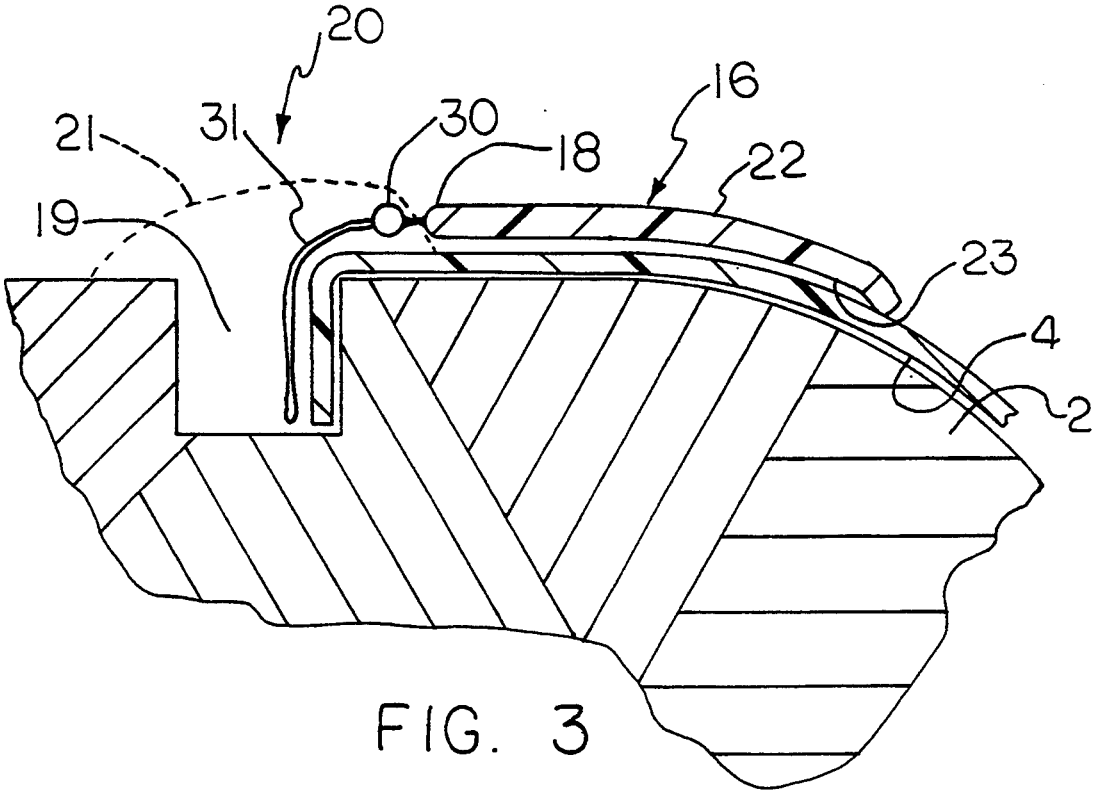
FIG. 3 is an enlarged sectional view of a portion of the landfill and insulating article shown in FIG. 2 to illustrate one type of anchoring of the system on the substrate.

The article, in the form of a panel 16 is secured at the top 9 of the sideslopes 4 with a conventional soil anchor 20, as is illustrated in FIG. 3 (without the soil filler, for clarity), by attaching the upper end 18 of the deployed panel 16 to an anchor flap 31 that has been installed in the trench 19, and backfilled with the excavated soil 21 (shown in phantom) over the anchor flap 31. It should be understood that the invention herein is not limited by the type of anchor that is used to anchor the panel (and other articles and the system of the invention) and thus, the panels 16, etcetera, can be anchored by posts or stakes, or posts or stakes in combination with ropes or cables, or wires, or windrows of soil over the edge of the panels 16, depending on what is needed or desired at the particular site.

Since the width of a panel 16 will not be sufficient to entirely cover the sideslope 4, a series of panels 16 are adjacently deployed as shown in FIG. 1 and in detail in FIG. 4. The exterior and interior side walls 22 and 23, respectively, or adjacent panels 16 can be fixed together to form a continuous blanket of panels 16 around the sideslopes 4 of the landfill containment cell 1 to form an insulative system having the configuration of a blanket.

It is anticipated in one embodiment of this invention that after its construction, the casings 13 (FIG. 7) will be stored and shipped as a roll to the landfill site, or the casings will be further subjected to manufacture by filling them with insulation and sealing them to prevent the insulation from coming out of the casing, the latter method being preferred herein. In the example of using casings 13 from a roll at the construction site, various roll sizes can be employed, the width of the rolls depending on economical and physical considerations of production, storage, shipping, handling and installation. Alternatively, the casings 13 can be cut into panels, folded, and banded onto pallets for delivery to the construction site.

In the case where the casing 13, for example, is received on a roll at the landfill containment cell 1, a length of the casing 13, corresponding to the vertical length of the sideslopes 4 to be covered, is cut from the roll. The casing 13 is deployed so that the chambers 17 extend downwardly along the sideslopes 4 along the longitudinal, or long axis of the chamber 17.

Once a number of casings 13 have been positioned over the sideslopes 4 of the landfill containment cell 1, the insulation 14 is filled into the chambers 17. To permit filling of the insulation 14, a fill opening 24 (FIG. 7) is cut into each casing 13, generally at one end of the casing 13. Also, provisions are made for venting excess air from filling without allowing escape of the insulation.

In one example of filling the casing 13 with insulation materials, polystyrene beads are blown or pumped through a hose (not shown) which can be inserted into the fill opening 24 in the casing 13. Pressurized air, or a solids handling pump is then used to convey the beads into the casing 13. In another embodiment of this invention, the casings 13 are prepared as above, and foamable, curable, materials, such as polyurethane foams can be used to fill the casings 13 to form the panels 16. In a further embodiment of this invention, it is contemplated within the scope of this invention to fill the casings 13 with insulative material 14 and then cause the insulative materials 14 to expand. For example, polystyrene beads can be further expanded in the panels 16 by the use of steam injected into the panels 16.

The amount of filling of the insulative material 14 and the thickness of casing 13, is dependent on what is needed or desired for the particular site being insulated.

After the casing 13 has been filled with insulation 14, the fill openings 24 can then be closed and sealed. This may entail the seaming of patches constructed of the casing material, over the fill openings. Various alternative materials could be used for the insulation 14 without detracting from the performance of the present invention.

Examples of the various materials which could be used includes various types of loose fill insulation, such as the expanded polystyrene beads mentioned in the example above, cellulosic materials, perlite, vermiculite, diatomaceous silica, cellular rubber compounds, glass fibers, synthetic fibers, and even reclaimed waste, such as shredded newsprint. Also, other types of foamed or cast insulation may be used, including other rigid plastic foams, insulating cement, foamed gypsum plaster, and foamed sulfur.

Turning now to the casing 13, and the other casings as disclosed and claimed herein, reference can be made to the FIGS. 6 to 11. The casing 13, generally is formed in a three layer construction that includes an outer or exterior wall 22, an inner or interior wall 23, and an intermediary or divider wall 25. For purposes of this invention, the term "divider wall" does not necessarily mean a full, continuous wall structure. The divider walls are designed to control the amount of separation of the casing side walls 22 and 23 and to provide for the lateral distribution and containment of the thermal insulation 14.

Figure 7:
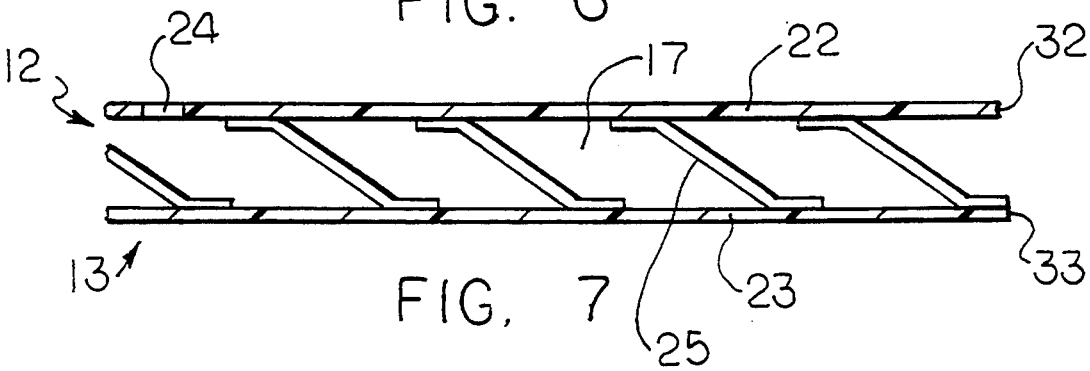
FIG. 7 is a cross-sectional view of an casing of this invention in as shown in FIG. 4, in the collapsed state.

The exterior wall 22 and interior wall 23 are opposing side walls which cooperate to define a general cavity within the casing 13 (FIG. 7). The divider walls 25 are located within this cavity, between the exterior and interior walls 22 and 23, and are affixed to such interior and exterior walls. These divider walls divide the cavity into a number of adjacent, generally dependent chambers 17. In defining the chambers 17, each divider wall 25 is secured at spaced apart intervals to the exterior wall 22 and the interior wall 23. The casing 13 is then finally formed by sealing the edges 32 and 33 together. Filling the casings 13 with insulation materials 14 can be carried out just prior to the final sealing, or it can be carried out after the entire casing 13 is sealed. If the latter is the case, the filling can be accomplished by pumping or blowing the insulation material 14 through a fill opening 24 as described above, and then sealing the fill opening 24 thereafter. Provisions may also be made for the venting of excess air from the casing during the filling operation. The finished panels 16 can then be transported directly to the construction site in this form. Means of placing the devices for securing the panels 16 to each other and on the substrate can be undertaken either before or after the transportation to the site, as this feature is not significantly critical and may have to be determined at the construction site.

All three walls of the casing 13 are preferably, but not necessarily, formed from the same material. Such sheet materials include the broad classes of polymeric materials used in geomembranes, geotextiles and combinations of these, among other materials. Without intending to limit the present invention, polymeric materials which can be used to form the casing 13 of the a much less significant consideration for the case of protecting a substrate against freeze-thaw.

It is also contemplated that the casing can be manufactured from permeable geotextiles, where the insulating material itself is resistant to water infiltration, or where the geoinsulation is to be used for protection from excessive heating in arid climates where water infiltration is less of a concern.

Finally, it is contemplated that the casing 13 can be manufactured using an impermeable geomembrane for the exterior wall 22 that will be exposed to the atmosphere while using a permeable geotextile for the interior wall 23 that will be in contact with the substrate. This will reduce the potential for water accumulation inside the casing 13, should precipitation infiltrate into the casing 13 through a defect in the impermeable exterior wall 22. Such water would be allowed to drain out of the casing 13 through the permeable interior wall 23, thereby preventing water accumulation. Also, this casing configuration will provide for the venting of air through the permeable interior wall 23 when it is being filled with insulation 14.

Using polyethylene as an example for a construction material for the entire casing 13, the divider wall 25 is secured to the exterior wall 22 and interior wall 23 by conventional methods. Without intending to limit the present invention, conventional methods for securing the divider wall 25 to the exterior and interior walls 22 and 23 include applying heat and pressure to induce fusing of the walls 22 and 23 and the divider walls 25. present invention, include thermoplastic polymers such as polyethylene and it's variations, polyvinyl chloride, polypropylene and polyester. Consideration in the selection of casing materials include permeability, strength, puncture resistance, ultraviolet resistance, thermal expansion coefficient, manufacturing consideration, and cost.

While different applications will dictate the use of different materials, it is believed that for most applications, thin (10 to 20 mil) multi-ply reinforced polyethylene is sufficient in terms of durability, ease of construction and cost. It is contemplated that the color of the casing material will be dictated by considerations of ultraviolet resistance, radiative heat transfer properties of the geoinsulation, and practical considerations.

The choice of color may present a compromise in the case of protecting a substrate against excessive heating. For example, a black casing may be more resistant to ultraviolet degradation than a light colored or clear casing because of the carbon black content, but it will cause the geoinsulation to absorb and radiate heat more readily. A clear casing may be advantageous because the geoinsulation could assume the white color of expanded polystyrene beads contained therein, causing the geoinsulation to be more resistant to radiative heat transfer. Also, a clear casing would allow for easy verification that the expanded polystyrene beads are evenly and completely distributed over the substrate. However, a clear casing may be less resistant to ultraviolet degradation that a black casing. It should be noted that radiative heat transfer is Considerations in selecting the specific bonding method include compatibility with the casing materials and cross section, cost, production rate, continuity and strength. Bonding methods are well known in the field of plastics manufacture, and for this reason, are not more fully discussed herein.

While the opposing side walls 22 and 23 are shown in the embodiment as being substantially parallel with one another, it should be understood that variations from this shape will occur as a result of the filling of the insulation 14 into the chambers 17. Similarly, the divider walls 25 may also vary from the exact configuration shown in the figures. An important consideration in the design of the casing is to create a casing that will have a relatively flat surface when it is filled with the insulating material. This will provide for drainage of precipitation off of the casing, reducing the potential for water accumulation over the casing and subsequent water infiltration into the insulation if there is a puncture in the casing. Another objective in the design of the casing is to create a casing that will collapse upon itself and lay flat when it is not filled with insulation. This will allow for efficient handling and storage of the casing on rolls prior to being filled with insulation One of the configurations of the casings found useful in this invention is shown at FIG. 6, wherein the casing 13 is shown in its expanded state, containing insulation materials 14. The same casing 13 is also illustrated in FIG. 7 in its unfilled state and flattened, which is the configuration that would be used to place the casing 13 on a roll for transportation, if desired.

preferred

Figure 8:
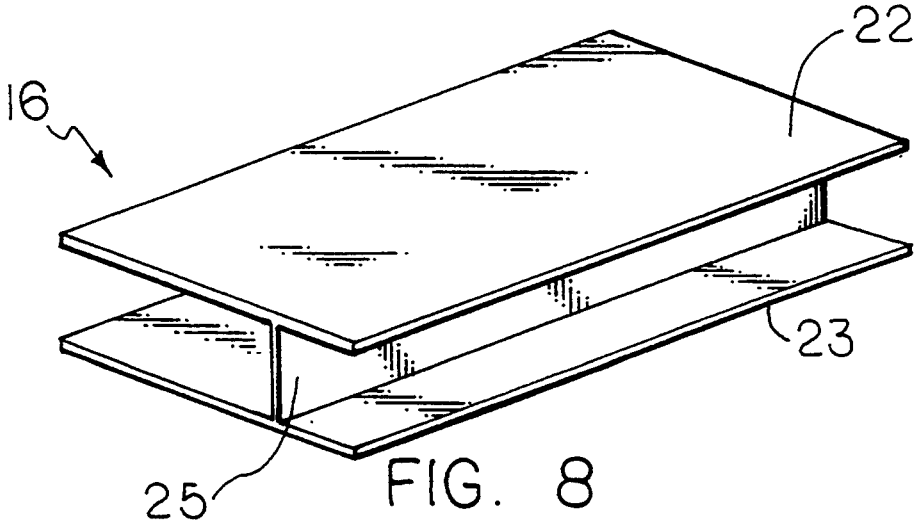
FIG. 8 is an isometric view of a portion of a casing of this invention embodying a continuous divider wall.

FIG. 8 shows yet another, although less construction containing a continuous divider wall 25.

Figure 9:
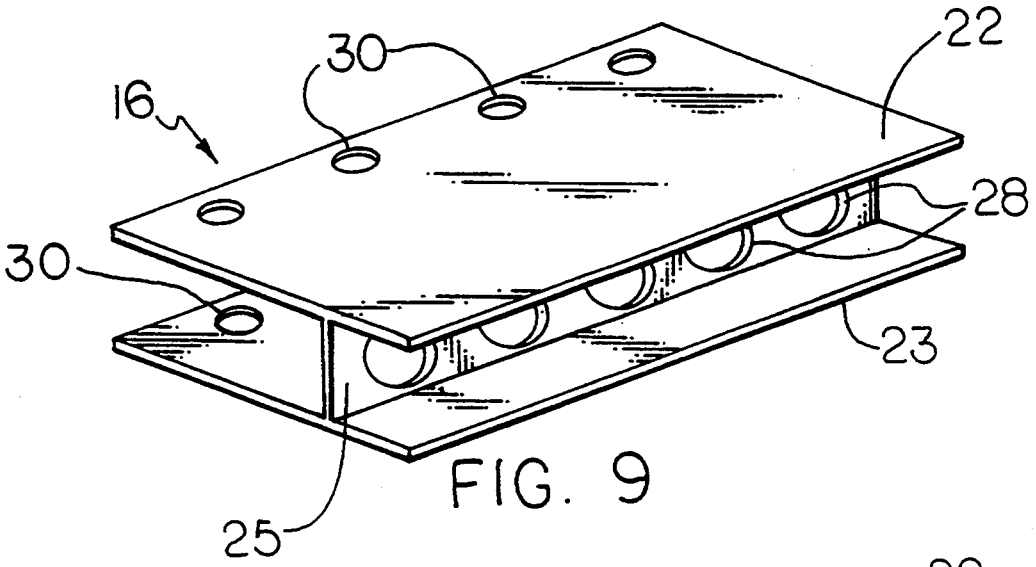
FIG. 9 is an isometric view of a portion of a casing of this invention embodying a continuous divider wall containing port holes.

FIG. 9 shows still another more preferred construction of a casing in which the divider walls 25 have a plurality of openings in them to provide for the lateral movement of any insulating material 14 introduced into the casing 13.

Figure 10:
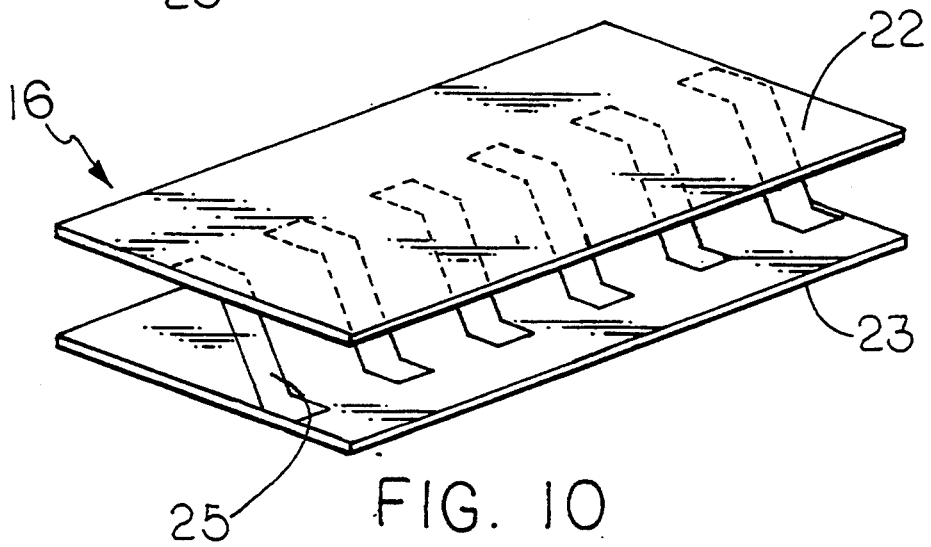
FIG. 10 is an isometric view of a portion of a casing of this invention embodying discontinuous ribbons as a divider wall.

A more preferred embodiment of a casing configuration is that shown in FIG. 10 in which a plurality of individual, discontinuous strips of ribbon or thread are used as the divider walls to hold the exterior and interior walls, 22 and 23 in place.

Figure 11:
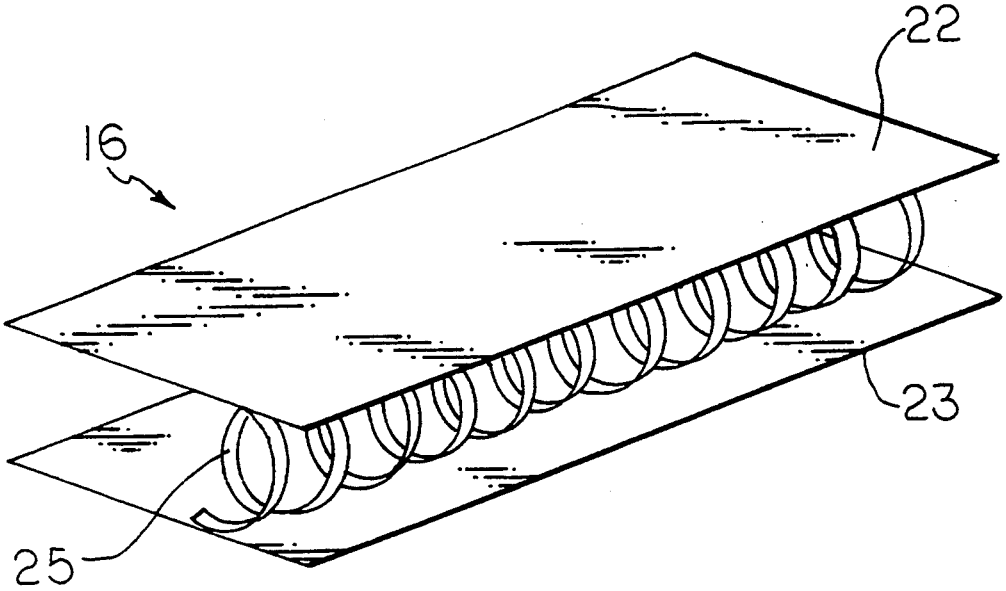
FIG. 11 is an isometric view of a portion of a casing of this invention embodying a helical ribbon as the divider wall.

Finally, another preferred embodiment of the divider wall 25 is that shown in FIG. 11, in which helical threads or ribbons are used as the divider walls 25. This configuration controls the separation of the exterior and interior walls 22 and 23, respectively, yet allows for lateral movement of the insulating material when it is introduced into the casing 13. Also, it is believed that this may be the most economical method of manufacture.

Thus, it can be observed that in their opened or expanded shape, the casings 13 of this invention include a number of substantially parallel and adjacent divider walls 25. These divider walls 25 define, more or less, chambers 17. By constructing the casings 13 as discussed above, it can be seen that the divider walls 25 partly partition the insulation into dependent chambers 17.

It is intended that the casings 13 be sealed around the edges 32 and 33, filled with insulating material 14 and then fastened to adjacent, like casings. For this purpose, and for the purpose of holding the systems on the substrate, there can be provided a means for fastening. Such means may include grommets 30 as shown, for example in FIGS. 3, 4, and 5, or other openings in the edges of the articles by which one could use electrical cable ties, rope, wire or the like to fasten the articles together. Also, it is contemplated within the scope of this invention to rivet them together, use screws, bolts/-nuts, snap fasteners, Velcro fasteners, or they can be taped. The form of fastening is not especially critical to this invention and whatever form best fits the particular installation, should be used, bearing in mind the effectiveness, cost and ease of use.

While the present invention has been described with particular reference to compacted clay hydraulic barriers, in view of the above discussion it can be seen that the invention has applicability beyond insulating hydraulic barriers. Other areas of potential thermal insulating uses for the invention include, without limitation, foundations or footings, road subgrades, thaw prevention applications, buildings, and concrete during curing. The invention may also be used for a floating cover over swimming pools or other large, open reservoirs to insulate the contents and/or protect the contents from contamination.

The invention may have use in agriculture and horticulture in that the articles of the invention can be used to keep the soil thawed in cold climates, the articles can be removed to allow preparation of the soil, seeds can be sown, and the articles can be replaced on the soil to keep the seeds insulated and the soil thawed.

Other structural applications where the casing 13 is filled with a load bearing material such as concrete may include ground stabilization, roadways, spread footings, and floorings. Containment applications where the casing 13 is filled with slurry with low hydraulic conductivity, may include slurry walls, liners and other hydraulic barriers. Protective cover applications may include protection of geomembranes, barricades, military bunker construction, and erosion control. Explosive applications include any use which requires the spreading of explosives over a large area.

While the above description constitutes the preferred embodiments of the present invention, it will be appreciated that the invention is susceptible to modification, variation and change without departing from the proper scope and fair meaning of the accompanying claims.

I claim:

1. A casing for use in containing thermal insulation, said casing comprising a flexible housing having spaced apart opposing side walls, said side walls being connected to each other by a plurality of flexible fasteners which cause the side walls to cooperatively define at least two chambers therebetween;

a means for detachedly fastening said casing to another adjacent similar casing;

a means for detachedly securing said casing on a substrate.

2. An article for thermally insulating a substrate, said article comprising a flexible casing said casing comprising a flexible housing having spaced apart opposing side walls, said side walls being connected to each other by a plurality of flexible fasteners which cause the side walls to cooperatively define at least two chambers therebetween;

there being contained in each said chamber, insulative material sufficient to thermally insulate said substrate;

a means for fastening the casing to another similar casing;

a means for detachedly securing said article on the substrate.

3. A method of thermally insulating a substrate, the method comprising (I) preparing the substrate;

(II) covering the substrate with one or more articles of claim 2;

(III) fastening each of said articles to at least one other similar adjacent article;

(IV) detachedly securing two or more of the articles on the substrate.

4. A method of thermally insulating a substrate, the method comprising covering a substrate with one or more articles of claim 2;

(II) fastening each of said articles to at least one other similar adjacent article;

(III) detachedly securing one or more of the articles on the substrate.

5. A method of thermally insulating a substrate, the method comprising (I) covering a pre-prepared substrate with one or more articles of claim 2;

(II) fastening each of said articles to at least one other similar adjacent article;

(III) detachedly securing two or more of the articles on the substrate.

6. A casing as claimed in claim 1 wherein the flexible fasteners are essentially parallel divider walls.

7. A casing as claimed in claim 6 wherein the divider wall is essentially formed by a single continuous wall positioned between said side walls, said continuous wall being alternatively secured to said opposing side walls.

8. A casing as claimed in claim 6 wherein the divider walls have a plurality of openings through them.

9. A casing as claimed in claim 1 wherein the flexible fasteners are essentially parallel divider walls which are helical ribbons, positioned between said side walls, said helical ribbons being alternatively secured to said opposing side walls.

10. A casing as claimed in claim 1 wherein the flexible fasteners are a plurality of essentially discontinuous ribbons having two ends, each said end fastened to opposite side walls.

11. A casing as claimed in claim 1 which is manufactured from a flexible sheet materials.

12. A casing as claimed in claim 11 wherein the flexible sheeting material is selected from a group consisting essentially of polyethylene, polypropylene, polyester, polyvinylchloride and polyurethane.

13. A casing as claimed in claim 12 which is coated.

14. A casing as claimed in claim 12 which is pigmented.

15. A casing as claimed in claim 14 which is white in color.

16. A casing as claimed in claim 14 which is black in color.

17. A casing as claimed in claim 12 which is clear.

18. An article as claimed in claim 2 wherein the insulating material is selected from a group consisting essentially of foamed polystyrene, foamed polyurethane, foamed polyester, perlite, newspaper, corncobs, foamed gypsum, organic foams, and the like.

19. An article as claimed in claim 18 wherein the insulating material is particulate in form.

20. An article as claimed in claim 18 wherein the insulating material is fibrous in form.

21. An article as claimed in claim 18 wherein the insulating material is formed inside the article.

22. A system for insulating a substrate, said system comprising a two or more of the articles of claim 2 secured together to form a blanket on the substrate, said system being secured on the substrate.

23. A method of installing the system of claim 22, the method comprising (I) placing on a prepared substrate, a plurality of articles comprising a flexible casing said casing comprising a flexible housing having spaced apart opposing side walls, said side walls being connected to each other by a plurality of flexible fasteners which cause the side walls to cooperatively define at least two chambers therebetween;

there being contained in each said chamber, insulative material sufficient to thermally insulate said substrate; a means for fastening the casing to another similar casing;

a means for detachedly securing said article on the substrate;

(II) detachedly securing each of the articles to any adjacent similar articles;

(III) detachedly securing said system on the substrate.

24. A method of installing the system of claim 22, the method comprising (I) preparing a substrate;

(II) placing on the prepared substrate, a plurality of articles comprising a flexible casing said casing comprising a flexible housing having spaced apart opposing side walls, said side walls being connected to each other by a plurality of flexible fasteners which cause the side walls to cooperatively define at least two chambers therebetween;

there being contained in each said chamber, insulative material sufficient to thermally insulate said substrate;

a means for fastening the casing to another similar casing;

a means for detachedly securing said article on the substrate;

(III) detachedly securing each of the articles to any adjacent similar articles;

(IV) detachedly securing said system on the substrate.

25. A method of installing the system of claim 22, the method comprising (I) covering a substrate with one or more casings each said casing comprising a flexible housing having spaced apart opposing side walls, said side walls being connected to each other by a plurality of flexible fasteners which cause the side walls to cooperatively define at least two chambers therebetween;

a means for detachedly fastening said casing to another adjacent similar casing;

a means for detachedly securing said casing on a substrate;

(II) detachedly fastening each of said casings to at least one other similar adjacent casing;

(III) detachedly securing one or more of the casings on the substrate and, (IV) filling the casing with thermal insulating material.

26. A method as claimed in claim 25 wherein essentially all of the casings are laid down on the substrate before any of the casings are filled with thermal insulation.

27. A method of constructing a casing, the method comprising (I) providing a first side wall;

(II) providing an opposing second side wall to form a cavity therebetween;

(III) providing at least one divider wall disposed between the first side wall and the opposing second side wall and forming at least two chambers from the cavity by securing each of the divider walls to the side walls, each said divider wall being alternatively secured to said opposing side walls.

28. A method of constructing an article, the method comprising (I) providing a first side wall of flexible material;

(II) providing an opposing second side wall of flexible material to form a cavity therebetween;

(III) providing at least one divider wall disposed between the first side wall and the opposing second side wall and forming at least two chambers from the cavity by fastening each of the divider walls to the side walls, each said divider wall being alternatively secured to said opposing side walls;

(IV) filling the chambers formed thereby with a thermal insulating material, and thereafter, (v) sealing the article to prevent the escape of the material of (IV) .

29. A method of constructing an article as claimed in claim 28, wherein the divider wall has a helical configuration said helical configuration being formed from flexible sheet material.

* * * * *